United States Patent [19]

Malik

[11] Patent Number: 4,498,652

[45] Date of Patent: Feb. 12, 1985

[54] WIRE RACK FOR PLASTIC BAG

[76] Inventor: James J. Malik, 6618 Bennington Dr., Parma Heights, Ohio 44130

[21] Appl. No.: 518,550

[22] Filed: Jul. 29, 1983

[51] Int. Cl.[3] ..... B65B 67/04

[52] U.S. Cl. ..... 248/99; D34/6

[58] Field of Search ..... 248/99, 97, 98, 100, 248/101, 95, 94, 128, 146, 175; 206/520; 232/43.1, 43.2; D34/6

[56] References Cited

U.S. PATENT DOCUMENTS

| | | | |
|---|---|---|---|
| D. 264,651 | 6/1982 | Adamson | D34/6 |
| D. 273,159 | 3/1984 | Adamson et al. | D34/6 |
| 447,686 | 3/1891 | Holladay | 248/100 |
| 666,296 | 1/1901 | Wiard | 248/99 |
| 2,778,554 | 1/1957 | Porkola | 248/99 |
| 4,267,997 | 5/1981 | Meier | 248/97 |
| 4,332,361 | 6/1982 | McClellan | 248/95 |
| 4,445,658 | 5/1984 | Ferron | 248/99 |
| 4,458,867 | 7/1984 | Malik | 248/97 |

*Primary Examiner*—William H. Schultz
*Assistant Examiner*—Ramon O. Ramirez
*Attorney, Agent, or Firm*—Alfred D. Lobo

[57] ABSTRACT

A wire rack is mounted on the inner surface of a door of a cabinet at a suitable height, and a plastic bag with integral handle-loops is suspended from the rack without supporting the body of the bag. The wire rack comprises a main wire member and a wire bail which interconnects ends of the main wire member. The bail is used to store individual bags to be used, or a package of unused bags. The main member has tab-shaped protrusions formed by the sides of the main member, and the handle-loops are slipped around the tab-shaped protrusions so as to hold the bag in an open-mouthed material-receiving attitude.

4 Claims, 5 Drawing Figures

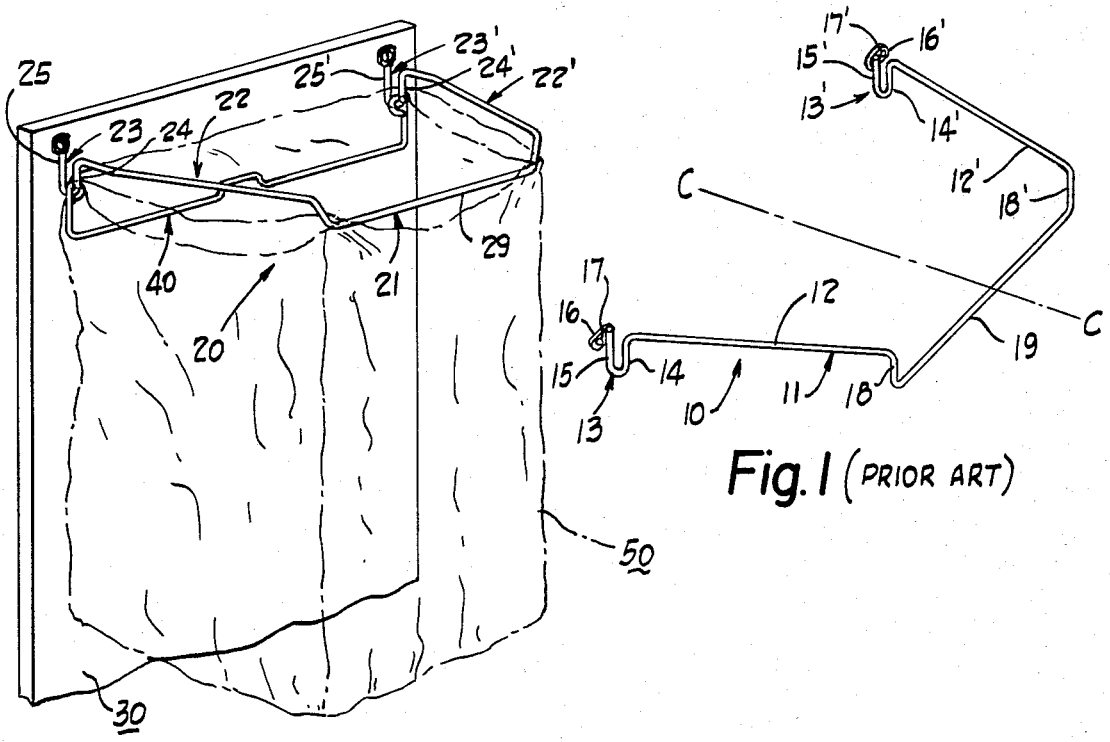
Fig. 2
Fig. 1 (PRIOR ART)
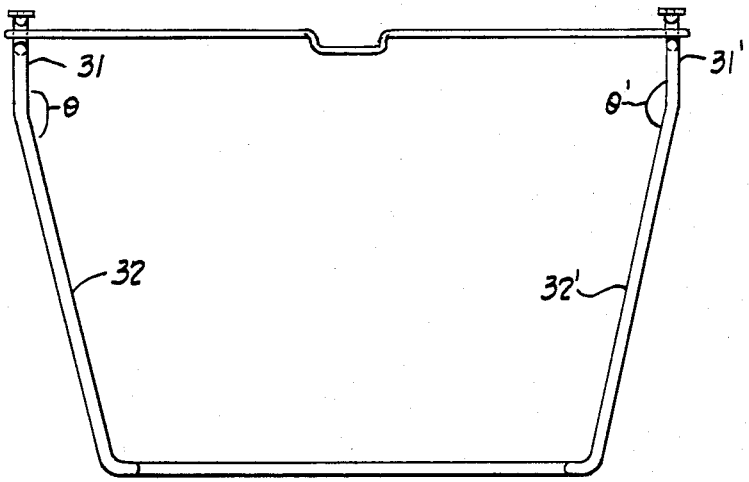
Fig. 3
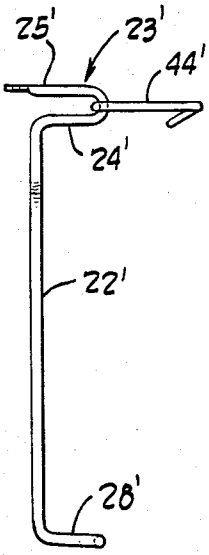
Fig. 4
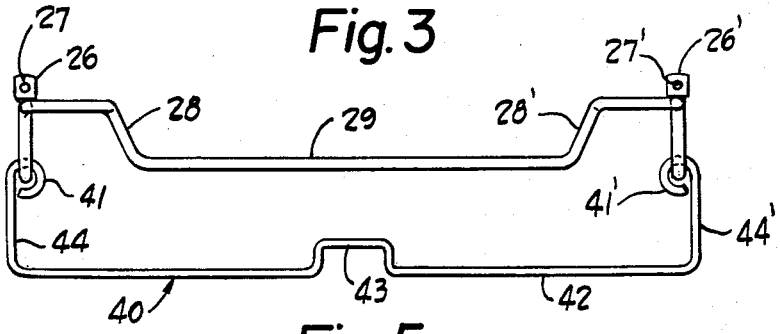
Fig. 5

WIRE RACK FOR PLASTIC BAG

BACKGROUND OF THE INVENTION

This invention relates to a class of articles or devices made from wire to provide a frame which is not a stand, the frame holding the mouth of a bag open while the bag is suspended within the frame without prongs, hooks or clamps, and without supporting the body of the bag.

Wire racks have attained a high degree of commercial acceptance because of the relative ease with which they may be fabricated, the low cost of wire stock and the short time required to fabricate them. Such racks are particularly popular for relatively small and light objects which must be displayed prominently; and to save storage space, such racks are collapsible as shown in my U.S. Pat. No. 3,726,415. Such racks are not generally regarded favorably for heavy duty applications, referred to as such because in such applications, these racks are subjected to rough treatment if not outright abuse. Treated roughly, the welded joints of the racks, typically resistance welded, are prone to failure. Having discovered this problem with wire racks made with resistance welds, the problem was to construct a functional and economical rack without using welds.

The device of this invention is particularly directed to the use of a plastic bag with integral handle loops, for temporarily storing material, particularly trash, garbage and the like such as is generated in a typical household. Such plastic bags are now conventionally used as grocery bags in which foodstuffs are packed, or shopping bags in which various articles are loaded so that the bags may then be conveniently hand-carried in one hand. Such a bag is described in greater detail in U.S. Pat. No. 4,062,170 which also discloses an apparatus for loading such a bag. A wire rack which achieves the same purpose more simply, elegantly and economically is disclosed in my copending patent application Ser. No. 476,070 filed Mar. 17, 1983, now U.S. Pat. No. 4,458,867.

The outstanding durability of such present-day plastic bags dictates that they be re-used, and they are, for a host of various applications in which less than about thirty pounds (30 lb) of material are to be hand-carried. One of the uses for such bags is for garbage generated in the kitchen of the home. Of course, it is not necessary that only at-least-once-used plastic bags be used as garbage bags. Most people, even those who are not affluent, are routinely prompted to purchase a package of new plastic bags solely for their use as garbage bags because it is more convenient than saving (by folding and storing), then re-using used bags. The problem is to store the package conveniently.

A logical, convenient and out-of-sight location for temporarily storing garbage is under a kitchen counter, and an ideal way to use a garbage bag is to have it held open in an upright, material-receiving attitude, adjacent an inner surface of a cabinet's door. When such a door is hingedly connected to a support strut of the cabinet, so that the door opens outwards to provide access to the storage space under the counter, it is desirable that one be able to open and close the door with the bag mounted as described, without the mounted bag and wire rack interfering with the normal action of he door.

To serve this function, it is immediately evident that any wire frame in which the bag is to be suspended should have angled sides in the horizontal plane, to provide the necessary clearance. The overall shape of the wire rack for mounting a garbage bag on the inside of a cabinet door's surface is therefore a flat-bottomed V, as described in greater detail hereafter.

In the foregoing context, and the logically dictated limitations as to angulation of the linear sides so as to provide suitable clearance for a rack-suspended garbage bag, a prior art rack required that mounting ears be welded to the vertical side supports which are integral with the angled, linear sides. The mounting ears are used to mount the rack to the inside surface of the cabinet door.

I discovered that, because of the difficulty of positioning the ears before they are welded to the wire, and the problems with respect to breakage of the welds, welding the ears was best avoided. When welded, the mounting ears were seldom positioned so that their rear mounting surfaces were coplanar. Therefore they would not lie flush against, that is, coextensively upon, the door's surface. Moreover, in ordinary use, the ears broke off prematurely with predictable customer dissatisfaction.

The rack of this invention avoids the problem of welding the mounting tabs on the rack, and does so by simplifying the construction of a device which, superficially, already appears to be of utmost simplicity.

SUMMARY OF THE INVENTION

An improved design for a wire rack specifically adapted to hold a plastic bag open by its integral handle-loops, obviates making any welds and the problem of positioning mounting ears precisely before they are welded. The rack comprises only two wire members, namely a main wire member, and a storage adapter (wire bail) which connects U-shaped end portions of the main wire member to give the rack a trapezoidal shape. Angulated sides (arms) of the rack permits ease and precision in fabrication of the rack. The wire bail is surprisingly effective for storing a package of unused bags without their occupying otherwise much-needed storage space in a crowded kitchen cabinet. Effective storage is provided by the simple wire bail which is slipped over the mounting ears before the rack is mounted, thus reinforcing the strength of the main wire member.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the several views and in which:

FIG. 1 is a perspective view of a prior art wire rack with resistance welded mounting ears.

FIG. 2 is a perspective view of the preferred embodiment of the wire rack of this invention showing a plastic bag (in phantom outline), held open to be filled, by means of integral handle-loops of the bag.

FIG. 3 is a top plan view of the preferred embodiment of the wire rack of this invention which may be disassembled for shipping and then assembled at the site where it is to be used.

FIG. 4 is a side elevational view of the rack as it is illustrated in FIG. 2, showing the tab-shaped protrusions formed by the sides of the rack, in elevation.

FIG. 5 is a front end elevational view of the rack shown in FIG. 2, showing the angulation of the sides and the storage adapter (wire bail) which makes it possible to store bags without using any more space than the rack when mounted, occupies.

DETAILED DESCRIPTION OF A PREFERRED EMBODIMENT

Individual bag structures, suitable for use in the practice of this invention, include those described in U.S. Pat. No. 3,180,557, and in German Gebrauchsmuster No. 1,844,267, inter alia, the disclosures of which are incorporated by reference as if fully set forth herein. Such plastic bags are desirably side gusseted, and may be formed from a gusseted flattened tube of thermoplastic material such as polyethylene. The gusseted flattened tube is heat sealed and severed along lengths of the tube which correspond to the height of the bag. One heat sealed and severed end is cut out in a generally U-shaped configuration intermediate the gusseted areas therein, forming an open bag mouth with loop handles on opposite sides thereof. These plastic bags are commonly used at present, details of their structure are well known, and need not be described herein nor illustrated in greater detail for the purposes at hand.

A prior art wire rack specifically constructed to hold a plastic bag (not shown in this view) open while it is loaded, is schematically illustrated in FIG. 1, the rack, which is to be mounted on a door, being generally indicated by the reference numeral 10. This rack comprises a single main member 11 which is bent as shown, in the shape of a flat-bottomed V, the coplanar arms 12 and 12' of which are linear and have U-shaped ends 13 and 13'. Arms 14 and 15 (and corresponding arms 14' and 15') of the U-shaped ends are bent so that they are essentially vertical and equal in length. Near the ends of the arms 15 and 15' are welded small, elliptical, relatively thick (so they will not bend) steel, mounting ears 16 and 16' with through-passages 17 and 17' therein, for mounting the rack 10 to a door. The through-passages are at the sides, transversely displaced from the arms 15 and 15', to allow room for using a tool such as a screw driver to fasten the rack with screws.

Because the arms 12 and 12' are linear and angled, and because the rear surface of the mounting ears 16 and 16' must be coplanar in the vertical plane, and also orthogonal (at right angle, or normal) to the horizontal plane in which the rack generally lies when it is mounted, and orthogonal to the longitudinal vertical plane in which the centerline C—C of the rack lies, it will quickly be evident that positioning the small mounting ears so they can be welded to the cylindrical outer surfaces of the arms 15 and 15' while maintaining their rear surfaces coplanar, is an unenviable production problem for one committed to making an inexpensive wire rack.

At the bottom of the V, arms 12 and 12' have short vertical stub portions 18 and 18' which are connected by a bottom (or front) member 19. The vertical stub portions 18 and 18' are about the same length as the arms 14 and 14' of the U-shaped end-portions, the result being that each linear side presents a tab-shaped vertical protrusion around which the handle-loops of the plastic bag are looped, the length of each tab-shaped portion being less than the width of a distended handle-loop.

Because the linear arms 12 and 12' are angled as shown, for clearance when a door is to be closed, the included angle will vary from about 60° to about 80°. By included angle I refer to the included angle between each side and a line connecting the sides, the line being in the vertical plane.

The design of the rack of my invention obviates the problem of welding mounting tabs on the wire member, and its angulated sides (as described herebelow) allow the rack to be fabricated with ease and surprisingly exceptional accuracy. Moreover, the rack may be used even where the space under a kitchen counter is highly limited, and it allows one to store new bags to be used, used bags to be re-used, towels or other items, conveniently, without taking up otherwise usable storage space in the cabinet.

Referring now to FIG. 2 there is shown a perspective view from a slightly elevated position, of a wire rack of my invention, indicated generally by reference numeral 20, shown mounted to the inner vertical surface of a swingably mounted cabinet door 30, so as to removably suspend a plastic garbage bag 50 (shown in phantom outline) from the rack. Typically, the door 30 is under the counter of a kitchen cabinet which houses a sink (not shown). The rack 20 comprises only two bent wire members, a first main member 21 upon which the bag is removably supported, and a second member indicated generally by reference numeral 40, referred to as a wire bail or bag storage adapter (hereafter "bail" for brevity), which removably connects U-shaped end-portions 23 and 23' of coplanar arms 22 and 22' of the wire member 21.

Though the term "wire" is used herein to refer specifically to a mild steel member, it will be recognized that an equivalent wire member may be formed from other metals such as aluminum, copper and the like, as well as certain synthetic resinous materials such as high density polyolefins which can be molded to have a "wire" form, and which have sufficient rigidity for the purposes to be served by the rack of this invention.

Referring now to FIGS. 3 and 4, in which are illustrated a top plan view and a side elevational view of the rack as it is seen in FIG. 2, respectively, it is seen that arms 25 and 25' are longer than arms 24 and 24', and each end of the arms 25 and 25' are flattened so as to provide integral mounting ears 26 and 26' symmetrically disposed about a vertical axis through vertical arms 25 and 25' and the rear surfaces of mounting ears 26 and 26' are coplanar so they may lie flush against, that is, in abutting coextensive relationship with the vertical surface of the door. Further, because the mounting ears are above the plane in which sides 22 and 22' lie, a fastening means may be used to mount the main member 21 by inserting a fastener through an aperture 27 and 27' provided in each mounting ear. Usually, a wood screw (not shown) is threadedly inserted into the door. Other fastening means may be used, for example a sheet metal screw threadedly inserted in a sheet metal door, or a machine screw and cooperating nut may be used to through-bolt the mounting ears 26 and 26' to the door, any of which fastening means requires a tool and adequate clearance to removably secure the rack to the door.

The front and rear surfaces of the mounting ear are substantially parallel to each other, the rear surfaces being contiguous to, and coextensive with, the inner surface of the door 30. Each U-shaped end portion 23 and 23' lies in the longitudinal plane which is at right angles to both the vertical surface of the door 30 and to the horizontal plane in which the mounted wire member 11 generally lies.

Each U-shaped end-portion 23 and 23' is at the end of a relatively short horizontal stub portion 31 and 31' respectively, and the longitudinal plane in which each U-shaped end-portion and each horizontal stub portion lie, is orthogonal to the vertical plane (the surface of the door). The horizontal stub portions 31 and 31' each range in length from one-fifth to about one-third the overall length of each of the arms 22 and 22'. The remaining longer portion of each arm is referred to as the angulated portion, and is designated in the drawing as 32 and 32'.

As is illustrated, the angulated portions 32 and 32' are angulated in the horizontal plane to form obtuse included angles $\theta$ and $\theta'$, respectively, the angle being sufficient to provide suitable clearance for opening and closing the door 30 with the rack mounted thereupon. Preferably, the angle is in the range from about 150° to about 170°.

Referring now to FIG. 5 where there is illustrated a front elevational view of the wire rack 20, it is seen that angulated portions 32 and 32' have downwardly extending inclined portions 28 and 28' which are each inclined relative to both (i) the longitudinal plane (which is at right angles to the vertical plane as represented by the surface of the door), and (ii) the horizontal plane as represented by the plane in which the mounted main wire member generally lies. The inclined portions 28 and 28' in cooperation with U-shaped portions 23 and 23' provide support for the handle-loops of the plastic bag 50.

The inclined portions 28 and 28' are connected by a bottom (or front) horizontal member 29 which is stepped down from the plane in which members 31, 31', 32, and 32' lie. The stepping down of the member 29 with inwardly downwardly inclined portions 28 and 28' cooperates to provide the tab-shaped protrusions necessary to engage the handle-loops of the plastic bag. It is preferred that the member 29 and the bottoms of the troughs of the U-shaped portions 23 and 23' be substantially coplanar.

Thus, viewed from above as illustrated in the plan view shown in FIG. 3, it is seen that the main wire member 21 is a unitary piece of wire having arms (sides) 32 and 32' which are angulated in the horizontal plane so that they converge symmetrically to a front member 29, each side including an obtuse angle $\theta=\theta'$.

The main wire member 21 is preferably made from heavy wire having a diameter in the range from about 0.1875 inch (in.) to about 0.3125 in., which when formed as shown, is relatively rigid, that is, too rigid to be deformed when weighted down by a plastic bag weighing even as much as 50 lb. It will be evident that the main member 21 is shaped by mechanical means such as are conventionally used in the wire forming art to deform wire stock.

The second member 40, referred to herein as a bail, is provided with end-loops 41 and 41' through which mounting ears 27 and 27' and vertical arms 25 and 25' are inserted so that the bail is swingably suspended between the troughs of the U-shaped portions 23 and 23'. The bail is used to store a package of plural stacked new or used plastic bags, and comprises a longitudinal portion 42 which is bent in the center to form an upright inverted-U-shaped protrusion 43 dimensioned so as to be inserted in a slot provided in the base of the package (not shown) which is the 'package form' in which new bags are presently marketed. The protrusion 43 is not quite vertical, being slightly less so, as shown in the drawings, so that the protrusion 43 protrudes slightly forward from the vertical plane to facilitate dispensing of bags stored on the bail. The angle of the protrusion is not critical provided it is not so acute that the stored bags will slide off. Typically, the angle is from about 60° to about 85°. A package of bags is thus removably secured on the member 43 and allows individual bags to be torn off the package which is held in a convenient attitude pointing slightly forward while hanging in a nearly vertical position.

As is illustrated in FIG. 5, the longitudinal portion 42 of the bail 40 terminates in vertical side portions 44 and 44' the ends of which are provided with end-loops 41 and 41'. The bail 40 is preferably made from wire stock having a diameter in the range from about 0.0625 in. to about 0.1875 in., which provides adequate rigidity to support the weight of the package of plastic bags.

The height at which the wire rack 20 is mounted depends upon the overall length of the plastic bag to be suspended open-mouthed in the rack, and is chosen so that the bottom of the bag, with material held therein, does not rest on the floor of the cabinet.

I claim:

1. A wire rack for mounting to the inner surface of a door of a cabinet so as to be able to open and close the door with a plastic bag suspended open-mouthed by its handle loops removably secured on the rack, said rack comprising, a generally trapezoidal device including in combination, (a) a main wire member for supporting said plastic bag in the open-mouthed position for receiving material, and (b) a wire bail upon which a package of plastic bags is removably secured, the bail forming the base of a trapezoid, said main member comprising, (i) a pair of side members angulated in the horizontal plane to include an obtuse angle so that the side members converge symmetrically into (ii) a front longitudinal member stepped down from the horizontal plane of the side members by downwardly extending portions inclined inwardly from the vertical, said side members being provided near their ends with (iii) U-shaped portions, each of which has one vertical arm which terminates in a mounting ear integrally formed by deforming an end of said main member to provide parallel faces, said mounting ear having a through-aperture for mounting said main member to said door's inner surface, whereby said side members form tab-shaped protrusions upon which said handle loops are secured; and, said wire bail comprising, (i) a longitudinal member terminating in oppositely disposed vertical side members having integral end-loops through each of which one said mounting ear is inserted so the bail is swingably disposed in the trough of each said U-shaped portion, and, (iii) an inverted-U-shaped portion formed integrally in said bail, at the center thereof, to provide a vertical protrusion upon which a package of plastic bags may be stored.

2. The wire rack of claim 1 wherein said front longitudinal member lies in substantially the same horizontal plane as the bottoms of the troughs of said U-shaped portions.

3. The wire rack of claim 2 wherein said main wire member is relatively rigid.

4. The wire rack of claim 3 wherein said main wire member is made from wire having a diameter in the range from about 0.1875 in. to about 0.3125 in., and said wire bail is made from wire having a diameter in the range from about 0.0625 in. to about 0.01875 in.

* * * * *